US009122181B2

(12) United States Patent
Hiraide

(10) Patent No.: US 9,122,181 B2
(45) Date of Patent: Sep. 1, 2015

(54) TONER FOR DEVELOPING AN ELECTROSTATIC CHARGE IMAGE AND TONER CARTRIDGE CONTAINING THE TONER

(71) Applicant: Oki Data Corporation, Tokyo (JP)

(72) Inventor: Manami Hiraide, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/039,407

(22) Filed: Sep. 27, 2013

(65) Prior Publication Data

US 2014/0099576 A1 Apr. 10, 2014

(30) Foreign Application Priority Data

Oct. 9, 2012 (JP) ..... 2012-224320

(51) Int. Cl.

| | |
|---|---|
| ***G03G 9/00*** | (2006.01) |
| ***G03G 9/087*** | (2006.01) |
| ***G03G 9/08*** | (2006.01) |
| ***G03G 15/08*** | (2006.01) |

(52) U.S. Cl.

CPC ..... *G03G 9/08755* (2013.01); *G03G 9/0804* (2013.01); *G03G 9/0821* (2013.01); *G03G 9/08795* (2013.01); *G03G 15/0877* (2013.01)

(58) Field of Classification Search

CPC ..... G03G 9/08755; G03G 9/0804
USPC ..... 430/105, 109.4, 137.1
See application file for complete search history.

(56) References Cited

U.S. PATENT DOCUMENTS 5,578,409 A * 11/1996 Kotaki et al. ..... 430/108.8
5,738,965 A * 4/1998 Nakadera et al. ..... 430/109.4
5,750,303 A * 5/1998 Inaba et al. ..... 430/108.4

FOREIGN PATENT DOCUMENTS

JP H11-052619 A 2/1999

* cited by examiner

*Primary Examiner* — Thorl Chea
(74) *Attorney, Agent, or Firm* — Rabin & Berdo, P.C.

(57) ABSTRACT

A toner for developing an electrostatic charge image, including toner particles obtained by dissolving or dispersing a binder resin and an additive in an organic solvent to prepare an oil phase component, and dispersing and granulating the oil phase component in an aqueous medium containing an inorganic dispersant dispersed therein, wherein the binder resin is a polyester resin obtained from an alcohol component, a carboxylic acid component, and a long-chain alkyl group represented by formula (1), the long chain alkyl group being present in a mole percent ranging from 6.5 to 7.5 mol % based on total number of moles of the alcohol component, the carboxylic acid component, and the long-chain alkyl group, and the polyester resin having an acid value of from 4.9 to 7.0 mgKOH/g:

(1)

6 Claims, 10 Drawing Sheets

FIG.6

| | Ratio of alkyl group in binder resin (mol%) | Acid value of binder resin (mgKOH/g) | Tricalcium Phosphate in toner | Location of wax in toner | Printing evaluation | | | Melt Viscosity at 150℃ (Pa·s) | Storage stability |
|---|---|---|---|---|---|---|---|---|---|
| | | | | | Fog | Filming | Glossiness | | |
| Exp. 1 | 7.0 | 4.9 | Absent | Center | Good | Good | Good | $1.3 \times 10^2$ | Good |
| Exp. 2 | 7.0 | 6.3 | Absent | Center | Good | Good | Good | $1.9 \times 10^2$ | Good |
| Exp. 3 | 6.5 | 7.0 | Absent | Center | Good | Good | Good | $3.6 \times 10^2$ | Good |
| Exp. 4 | 7.5 | 5.5 | Absent | Center | Good | Good | Good | $2.7 \times 10^2$ | Good |
| Comp. Exp. 1 | 8.0 | 2.8 | Absent | Center | Good | Good | Excellent | $0.93 \times 10^2$ | Poor |
| Comp. Exp. 2 | 15.0 | 8.7 | Present | Center | Poor | Good | Fair | $25 \times 10^2$ | Poor |
| Comp. Exp. 3 | 7.0 | 3.4 | Absent | Surface | Good | Poor | – | – | Poor |
| Comp. Exp. 4 | 5.0 | 6.2 | Absent | Surface | Good | Poor | – | – | Poor |
| Comp. Exp. 5 | 7.5 | 4.8 | Absent | Surface | Good | Poor | – | – | Poor |

FIG.9

| | Ratio of alkyl group in binder resin (mol%) | Acid value of binder resin (mgKOH/g) | Weight-average molecular weight of binder resin | Tricalcium Phosphate in toner | Location of wax in toner | Printing evaluation | | | Melt Viscosity at 150°C (Pa·s) | Storage stability |
|---|---|---|---|---|---|---|---|---|---|---|
| | | | | | | Fog | Filming | Glossiness | | |
| Exp. 5 | 7.5 | 6.5 | 18,000 | Absent | Center | Good | Good | Excellent | $1.2 \times 10^2$ | Good |
| Exp. 6 | 7.5 | 6.8 | 14,000 | Absent | Center | Good | Good | Excellent | $0.98 \times 10^2$ | Good |
| Exp. 1 | 7.0 | 4.9 | 16,000 | Absent | Center | Good | Good | Good | $1.3 \times 10^2$ | Good |
| Exp. 2 | 7.0 | 6.3 | 20,000 | Absent | Center | Good | Good | Good | $1.9 \times 10^2$ | Good |
| Exp. 3 | 6.5 | 7.0 | 28,000 | Absent | Center | Good | Good | Good | $3.6 \times 10^2$ | Good |
| Exp. 4 | 7.5 | 5.5 | 21,000 | Absent | Center | Good | Good | Good | $2.7 \times 10^2$ | Good |

TONER FOR DEVELOPING AN ELECTROSTATIC CHARGE IMAGE AND TONER CARTRIDGE CONTAINING THE TONER

BACKGROUND OF THE INVENTION

1. Field of the Invention

The present invention relates to a toner for developing an electrostatic charge image used in an electrophotographic printer or the like, a toner cartridge containing the toner, a developing device and an image forming apparatus using the toner, and a method for producing the toner.

2. Description of the Related Art

A technique for producing a toner by a dissolution suspension method is known (See, for example, Japanese Patent Application Publication No. 11-052619).

However, a toner produced by the conventional dissolution suspension method may cause poor printing quality.

SUMMARY OF THE INVENTION

An aspect of the present invention is intended to provide good printing quality.

According to an aspect of the present invention, there is provided a toner for developing an electrostatic charge image, including toner particles obtained by dissolving or dispersing a binder resin and an additive in an organic solvent to prepare an oil phase component, and dispersing and granulating the oil phase component in an aqueous medium containing an inorganic dispersant dispersed therein. The binder resin is a polyester resin obtained from a material containing from 6.5 to 7.5 mol % of a long-chain alkyl group represented by the following formula (1), the polyester resin having an acid value of from 4.9 to 7.0 mgKOH/g:

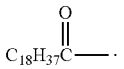

(1)

According to another aspect of the present invention, there is provided a method for producing a toner for developing an electrostatic charge image, including: dissolving or dispersing a binder resin and an additive in an organic solvent to prepare an oil phase component; and dispersing and granulating the oil phase component in an aqueous medium containing an inorganic dispersant dispersed therein. The binder resin is a polyester resin obtained from a material containing from 6.5 to 7.5 mol % of a long-chain alkyl group represented by the following formula (2), the polyester resin having an acid value of from 4.9 to 7.0 mgKOH/g:

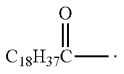

(2)

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 6 is a table showing results of an evaluation in Example 1;

FIG. 9 is a table showing results of an evaluation in Example 2; and

DETAILED DESCRIPTION OF THE INVENTION

Figure 1:
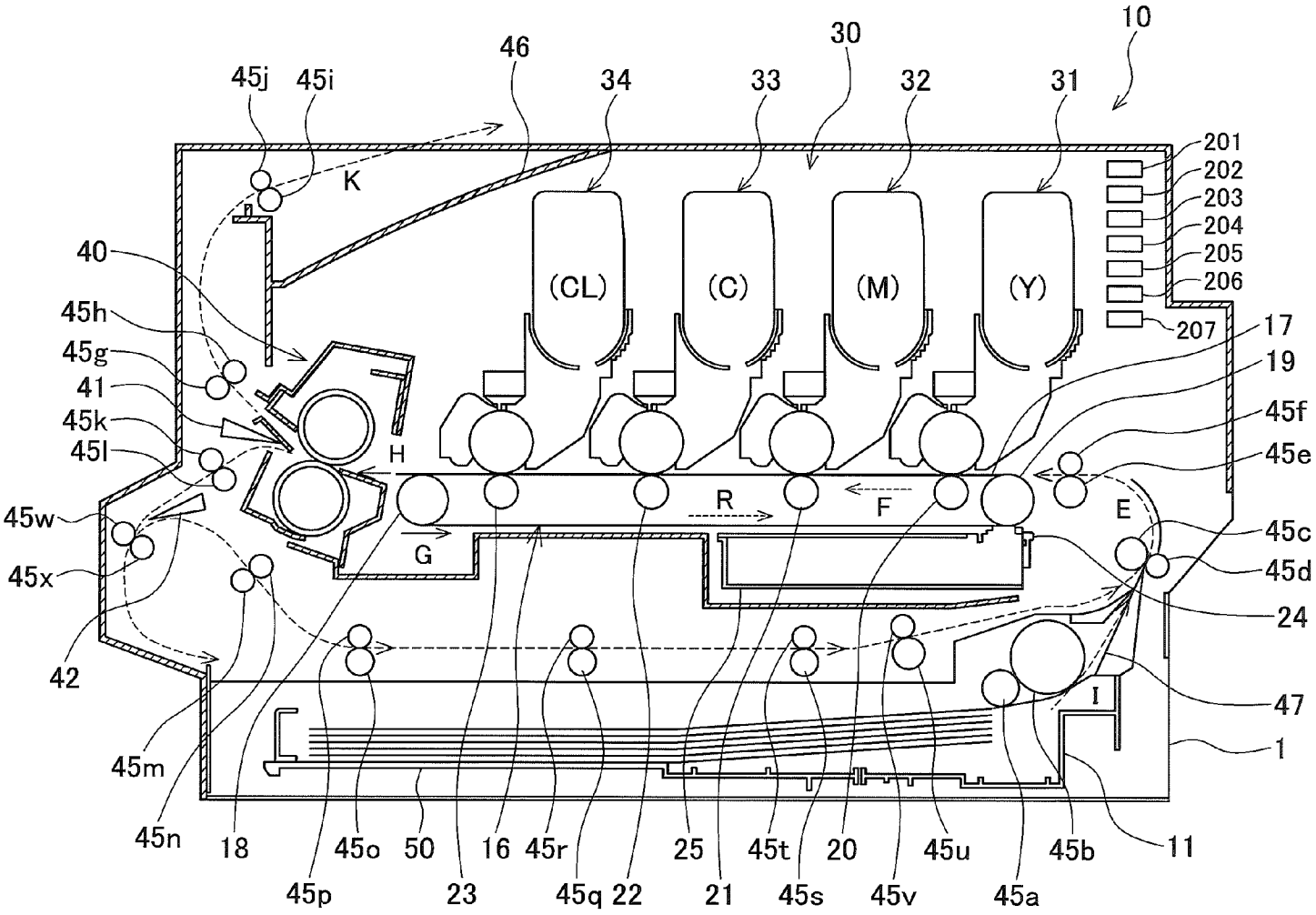
FIG. 1 is a schematic view showing a configuration of an image forming apparatus in an embodiment of the invention.

An embodiment of the invention will now be described with reference to the attached drawings, in which like elements are indicated by like reference characters. This embodiment is preferably applied to a clear or transparent toner for electrophotography.

<Toner>

A toner for developing an electrostatic charge image in this embodiment is obtained by dissolving or dispersing a binder resin and an additive in an organic solvent to prepare an oil phase component, and dispersing the oil phase component in an aqueous medium containing an inorganic dispersant dispersed in the aqueous medium to form particles.

The binder resin is a polyester resin modified with a long-chain alkyl group represented by the above formula (1) to increase the hydrophobicity of the polyester resin. The polyester resin is obtained from a material containing from 6.5 to 7.5 mol % of the long-chain alkyl group. The ratio of the amount of the long-chain alkyl group contained in the material to the total amount of the material is 6.5 mol % or more and 7.5 mol % or less. Specifically, the polyester resin is synthesized using an alcohol component, a carboxylic acid component, and the long-chain alkyl group of the formula (1) as the material, and the percentage of the number of moles of the long-chain alkyl group with respect to the total number of moles of the material (i.e., the alcohol component, the carboxylic acid component, and the long-chain alkyl group) is 6.5 mol % or more and 7.5 mol % or less. The polyester resin has an acid value of 4.9 mgKOH/g or more and 7.0 mgKOH/g or less.

Preferably, the polyester resin has a weight-average molecular weight of 14,000 or more and 18,000 or less, and the toner has a melt viscosity at 150° C. of $1.2\times10^2$ Pa·s or less.

In one aspect, the additive is free of colorants, and the toner is a clear toner.

<Image Forming Apparatus>

An image forming apparatus including a developing device according to this embodiment will now be described.

FIG. 1 is a schematic view showing a configuration of the image forming apparatus 10 according to this embodiment. The image forming apparatus 10 is, for example, a color electrophotographic printer. Specifically, the image forming apparatus 10 includes a recording paper cassette 11, developing devices 31 to 34, a transfer unit 16, and a fixing unit 40. Further, the image forming apparatus 10 includes paper conveying rollers 45*a* to 45*x* for conveying a recording paper 50 as a printing medium to the transfer unit 16 and the fixing unit 40, and conveying path switching guides 41 and 42. The developing devices 31 to 34 use the above described toner.

The recording paper cassette 11 stores the recording papers 50 in a stacked manner, and is detachably mounted in a lower part of a main body 1 of the image forming apparatus 10. The paper conveying rollers 45*a* and 45*b* feed the recording papers 50 stored in the recording paper cassette 11 one by one from the top to a paper conveying path in a direction shown by arrow L. The conveying rollers 45*c* and 45*d* and the conveying rollers 45*e* and 45*f* convey the recording paper 50 along arrow E to an image forming part 30 and correct a skew of the recording paper 50 being conveyed.

The image forming part 30 includes the four developing devices 31 to 34 arranged in series along the paper conveying path, and the transfer unit 16 for transferring toner images, described later, formed by the developing devices 31 to 34 onto the upper surface of the recording paper 50 by Coulomb force. The four developing devices 31 to 34 are detachably disposed in the main body 1, and have substantially the same configuration except that they use toners of different colors. While a typical color printer uses toners of four colors of black (K), yellow (Y), magenta (M), and cyan (C), the image forming apparatus 10 in this embodiment uses a clear (CL) toner in place of the black toner. In FIG. 1, the developing devices 31 to 34 use yellow (Y), magenta (M), cyan (C), and clear (CL) toners, respectively. The image forming apparatus 10 prints black images by mixing the yellow, magenta, and cyan toners.

The transfer unit 16 includes a transfer belt 17, a driving roller 18, a tension roller 19, transfer rollers 20 to 23, a transfer belt cleaning blade 24, and a toner box 25. The transfer belt 17 electrostatically attracts the recording paper 50 and conveys it. The driving roller 18 is rotated by a driving unit 201 to drive the transfer belt 17. The tension roller 19 stretches the transfer belt 17 together with the driving roller 18. The transfer rollers 20 to 23 are disposed in pressure contact with respective photosensitive drums 101 (see FIG. 2) in the developing devices 31 to 34 via the transfer belt 17. The transfer rollers 20 to 23 are applied with voltages to transfer the toner images from the photosensitive drums 101 to the recording paper 50. The transfer belt cleaning blade 24 scrapes off a toner adhering to the transfer belt 17 to clean the transfer belt 17. The toner box 25 stores the toner scraped off by the transfer belt cleaning blade 24.

Figure 2:
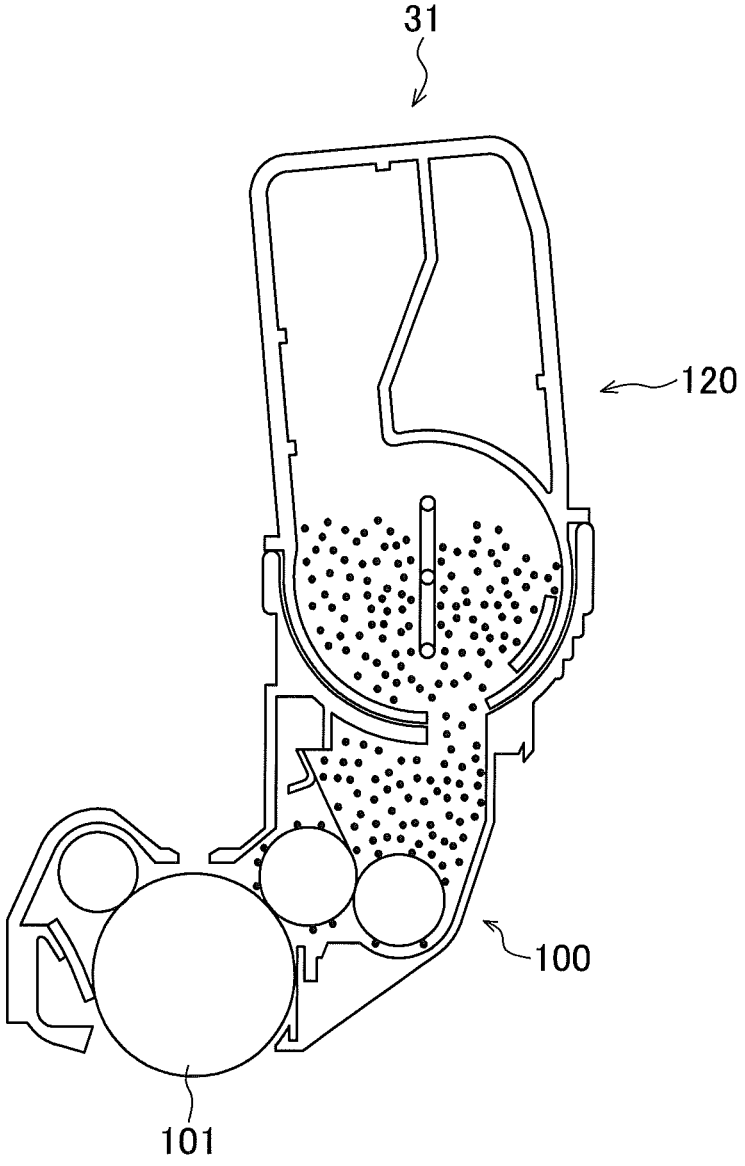
FIG. 2 is a schematic view showing a configuration of a developing device in the embodiment.

The configuration of the yellow developing device 31 will now be described. FIG. 2 is a schematic view showing the configuration of the developing device 31. As shown in FIG. 2, the developing device 31 includes a developing portion 100 and a toner cartridge 120 as a developer container. The developing device 31 is detachably mounted at a predetermined position in the main body 1 of the image forming apparatus 10 (see FIG. 1). The toner cartridge 120 is detachably mountable to the developing portion 100.

Figure 3:
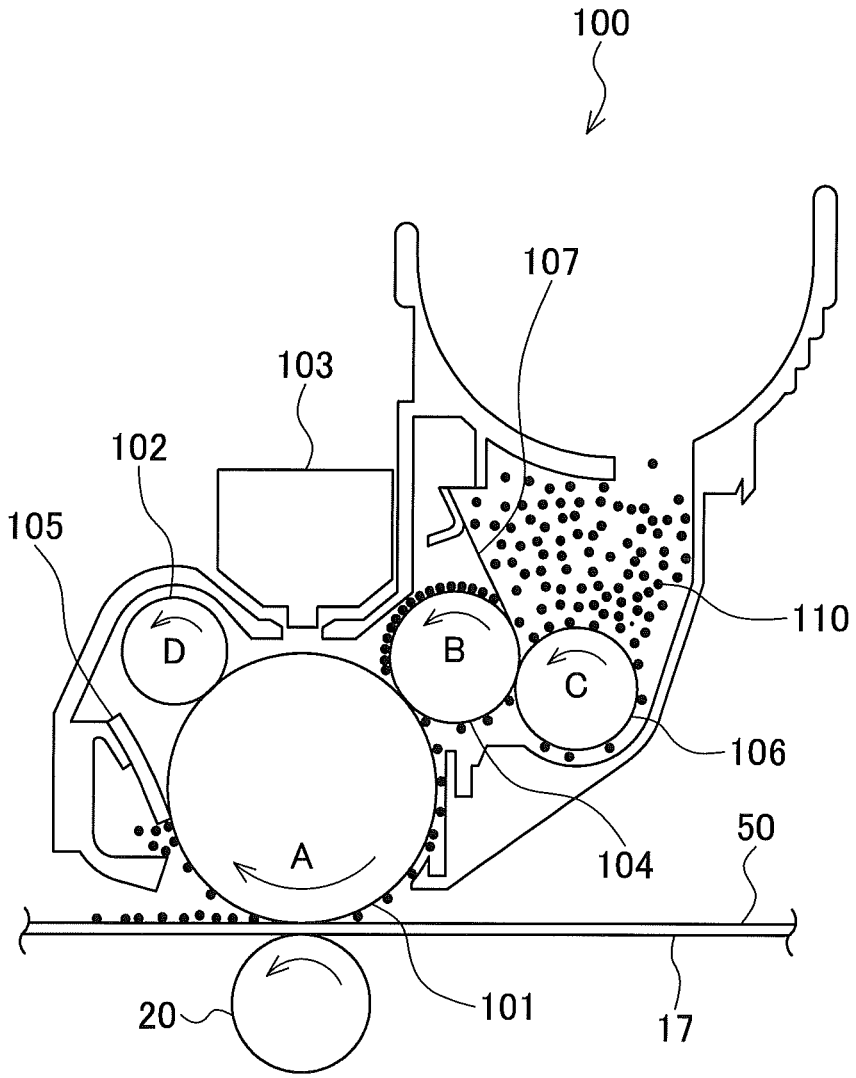
FIG. 3 is an enlarged view schematically showing a main part of a developing portion of the developing device in the embodiment.

FIG. 3 is an enlarged view schematically showing a main part of the developing portion 100 of the developing device 31 (see FIG. 2). In FIG. 3, the developing portion 100 includes the photosensitive drum 101 as an electrostatic latent image carrier, a charging roller 102 as a charging device, a developing roller 104 as a developer carrier, a supplying roller 106 as a developer supplying body, a toner 110 as a developer, a developing blade 107 as a developer regulating member, and a cleaning blade 105 as a developer collection device. The main body 1 of the image forming apparatus 10 is provided with an LED (Light Emitting Diode) head 103 as an exposure device.

The photosensitive drum 101 includes an electrically conductive support and a photoconductive layer. Specifically, the photosensitive drum 101 is an organic photoreceptor having a metal pipe made of aluminum as the electrically conductive support and a charge generation layer and a charge transport layer sequentially laminated on the metal pipe as the photoconductive layer. The charging roller 102 is disposed in contact with a peripheral surface of the photosensitive drum 101. The charging roller 102 includes a metal shaft and a semiconductive epichlorohydrin rubber layer. The LED head 103 is disposed to face the photosensitive drum 101. The LED head 103 includes, for example, LED elements and a lens array. The LED elements and the lens array are disposed so that light emitted from the LED elements is focused on the surface of the photosensitive drum 101.

The developing roller 104 is disposed in contact with the peripheral surface of the photosensitive drum 101. The developing roller 104 includes a metal shaft and a semiconductive urethane rubber layer. The supplying roller 106 is in sliding contact with the developing roller 104. The supplying roller 106 includes a metal shaft and a semiconductive foamed silicone sponge layer.

The toner 110 uses a polyester resin as a binder resin. The toner 110 includes a polyester resin, a charge control agent and release agent as an internal additive, and silica fine particles as an external additive.

The developing blade 107 is in pressure contact with the surface of the developing roller 104, and is made of stainless steel. The cleaning blade 105 is in pressure contact with the peripheral surface of the photosensitive drum 101, and is made of urethane rubber.

Figure 4:
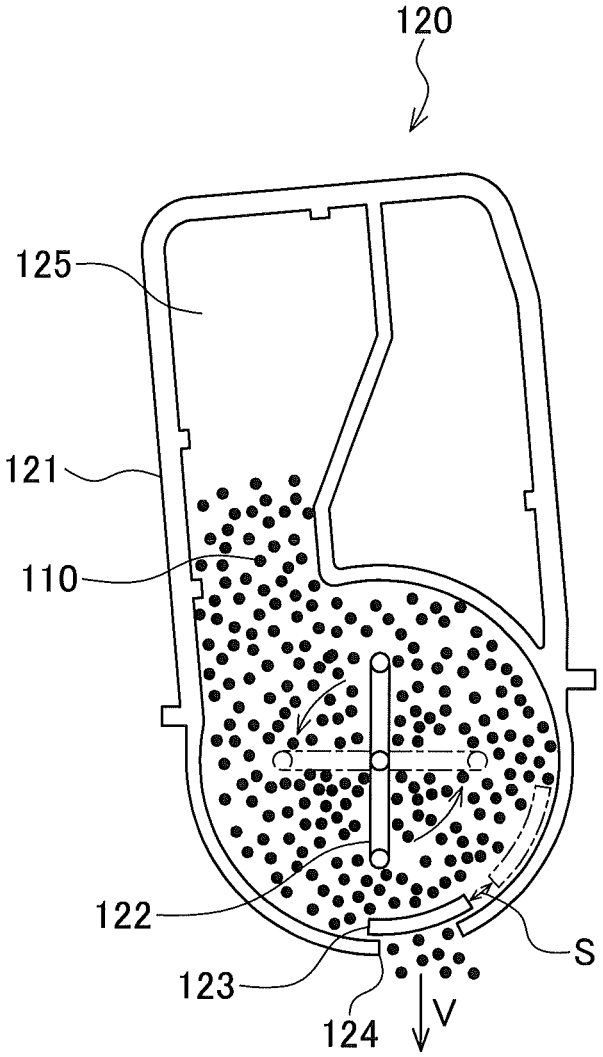
FIG. 4 is a schematic view showing an internal configuration of a toner cartridge of the developing device in the embodiment.

FIG. 4 is a schematic view showing the internal configuration of the toner cartridge 120 of the developing device 31 (see FIG. 1). As shown in FIG. 4, the toner cartridge 120 includes a container 121 having a toner storage portion 125, an agitating bar 122, and a shutter 123. The toner storage portion 125 is a storage portion storing the toner 110. The agitating bar 122 is rotatably supported in the toner storage portion 125 in place, and extends in its longitudinal direction (a direction perpendicular to the paper on which FIG. 4 is drawn). An outlet 124 for discharging the toner from the container 121 is formed below the agitating bar 122. The shutter 123 is a member for opening and closing the outlet 124. The shutter 123 is disposed in the container 121 slidably in a direction of arrow S to open and close the outlet 124.

Figure 5:
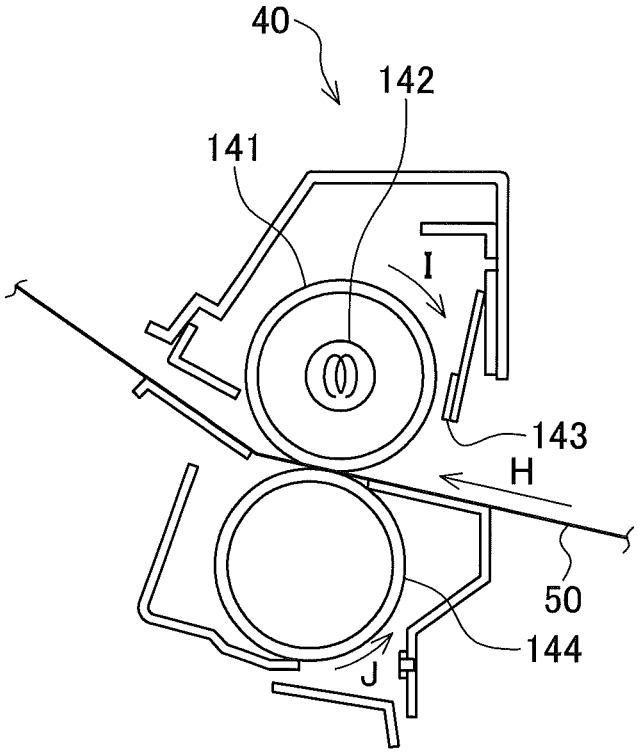
FIG. 5 is a schematic view showing an internal configuration of a fixing unit of the image forming apparatus in the embodiment.

The recording paper 50 onto which the respective color toner images have been transferred in the image forming part 30 as described later is conveyed on the conveying path in a direction of arrow H in FIG. 1 to the fixing unit 40. FIG. 5 is a schematic view showing the internal configuration of the fixing unit 40. As shown in FIG. 5, the fixing unit 40 includes a heating roller 141, a pressure roller 144, a thermistor 143, and a heater 142. The heating roller 141 includes a hollow cylindrical metal core made of aluminum, a heat-resistant elastic layer made of silicone rubber covering the metal core, and a PFA (tetrafluoroethylene-perfluoro alkylvinylether copolymer) tube covering the elastic layer. The heater 142 is provided inside the metal core of the heating roller 141. In this embodiment, a halogen lamp is used as the heater 142.

The pressure roller 144 includes a metal core made of aluminum, a heat-resistant elastic layer made of silicone rubber covering the metal core, and a PFA tube covering the elastic layer. The pressure roller 144 is arranged to form a pressure contact portion or nip portion between the heating roller 141 and the pressure roller 144. The thermistor 143 detects a temperature of a surface of the heating roller 141. The thermistor 143 is disposed in the vicinity of the heating roller 141 in a non-contact manner. The thermistor 143 transmits temperature information indicating the detected surface temperature to a temperature control unit 202 (see FIG. 1). The temperature control unit performs ON/OFF control of the heater 142 based on the temperature information to maintain the surface temperature of the heating roller 141 at a predetermined temperature, which is referred to as a fixing temperature.

An image forming process of the image forming apparatus 10 will now be described. First, a developing process will be described. As shown in FIG. 3, the photosensitive drum 101 is rotated by a driving unit 203 (see FIG. 1) in a direction of arrow A at a constant circumferential speed. The charging roller 102 applies a direct voltage supplied by a charging roller high voltage power source 204 (see FIG. 1) to the surface of the photosensitive drum 101 to uniformly charge the surface, while rotating in a direction of arrow D. Then, the LED head 103 irradiates light corresponding to an image signal to the uniformly charged surface of the photosensitive drum 101, so that potential of the light-irradiated portion is lowered and thereby an electrostatic latent image is formed on the photosensitive drum 101.

Meanwhile, after the toner cartridge 120 has been attached to the developing portion 100 as shown in FIG. 2, the shutter 123 of the toner cartridge 120 in FIG. 4 slides by operation of a lever provided to the toner cartridge 120 in an opening direction, which is a direction of arrow S to open the outlet 124 of the container 121. This allows the toner 110 in the container 121 to fall through the outlet 124 in a direction of arrow V and be supplied to the developing portion 100 shown in FIG. 2. In the developing portion 100, the supplied toner 110 is supplied to the developing roller 104 by rotation of the supplying roller 106, which is applied with a voltage from a supplying roller high voltage power source 205 (see FIG. 1), in a direction of allow C.

The developing roller 104 is disposed in close contact with the photosensitive drum 101, and is applied with a voltage from a developing roller high voltage power source 206 (see FIG. 1). The developing roller 104 attracts the toner 110 supplied from the supplying roller 106, and rotates to convey the toner 110 in a direction of arrow B. In this time, the developing blade 107, which is disposed in pressure contact with the developing roller 104 at a downstream side of the supplying roller 106, regulates the toner on the developing roller 104 to form a toner layer having a uniform thickness.

The developing roller 104 reversely develops the electrostatic latent image formed on the photosensitive drum 101 using the toner carried on the developing roller 104, as described below. Since a bias voltage is applied between the electrically conductive support of the photosensitive drum 101 and the developing roller 104 by a high-voltage power source, lines of electric force are generated between the developing roller 104 and the photosensitive drum 101 according to the electrostatic latent image formed on the photosensitive drum 101. Thus, the charged toner 110 on the developing roller 104 adheres to the electrostatic latent image portion on the photosensitive drum 101 by the electrostatic force, so that the latent image is developed to form a toner image. The above described developing process, which begins with initiation of the rotation of the photosensitive drum 101, is started at a predetermined timing described later.

In FIG. 1, the recording papers 50 stored in the recording paper cassette 11 are fed one by one from the recording paper cassette 11 by the paper conveying rollers 45*a* and 45*b* in the direction of arrow L. Then, the recording paper 50 is conveyed by the paper conveying rollers 45*c* and 45*d* and the paper conveying rollers 45*e* and 45*f* in the direction of arrow E along a recording paper guide 47 while the skew of the recording paper 50 is corrected. The recording paper 50 is fed to the transfer belt 17, which rotates in a direction of arrow F by the driving roller 18 rotating in a direction of arrow G. The above described developing process is started at a predetermined timing while the recording paper 50 is being conveyed in a direction of arrow E.

As shown in FIG. 3, the transfer roller 20 is disposed in pressure contact with the photosensitive drum 101 in the developing portion 100 of the developing device 31 of yellow (Y) across the transfer belt 17. The transfer roller 20 is applied with a voltage from a transfer roller high voltage power source 207 (see FIG. 1). The transfer roller 20 transfers the yellow toner image formed on the photosensitive drum 101 by the above developing process onto the recording paper 50 which is electrostatically attracted and conveyed by the transfer belt 17. This process is referred to as a transfer process.

Then, the recording paper 50 advances along arrow F on the transfer belt 17. The same developing process and transfer process as those performed by the developing device 31 and the transfer roller 20 are performed for magenta, cyan, and clear in this order. Specifically, a magenta toner image is transferred to the recording paper 50 by the developing device 32 and the transfer roller 21, a cyan toner image is transferred to the recording paper 50 by the developing device 33 and the transfer roller 22, and a clear toner image is transferred to the recording paper 50 by the developing device 34 and the transfer roller 23. The recording paper 50 onto which the toner images of the respective colors have been transferred is conveyed in the direction of arrow H.

As shown in FIG. 5, the recording paper 50 with the transferred toner image is conveyed in the direction of arrow H into the fixing unit 40, which includes the heating roller 141 and the pressure roller 144. The recording paper 50 with the transferred toner image advances between the heating roller 141 rotating in a direction of arrow I with its surface temperature controlled and maintained at the predetermined temperature by the temperature control unit and the pressure roller 144 rotating in a direction of arrow J. The heating roller 141 applies heat to the toner image on the recording paper 50 to melt the toner image, and the heating roller 141 and the pressure roller 142 apply pressure to the melted toner image on the recording paper 50 at the pressure contact portion, so that the toner image is fixed on the recording paper 50. This process is referred to as a fixing process.

The recording paper 50 with the toner image fixed thereon is conveyed by the paper conveying rollers 45*g* and 45*h* and the paper conveying rollers 45*i* and 45*j* shown in FIG. 1 in a direction of arrow K, and is discharged to a stacker 46 outside the image forming apparatus 10.

As shown in FIG. 3, a small amount of the toner 110 may not be transferred onto the recording paper 50 and remain on the surface of the photosensitive drum 101 after transfer. The residual toner 110 is removed by the cleaning blade 105. The cleaning blade 105 is disposed in parallel to a rotation axis of the photosensitive drum 101 extending in the longitudinal direction (a direction perpendicular to the paper on which FIG. 3 is drawn). The cleaning blade 105 is fixed in such a manner that a base portion of the cleaning blade 105 is attached to a rigid supporting plate and a tip of the cleaning blade 105 contacts the surface of the photosensitive drum 101. As the photosensitive drum 101 rotates about the rotation axis in a state where the tip of the cleaning blade 105 contacts the peripheral surface of the photosensitive drum 101, the cleaning blade 105 removes the residual toner 110 from the surface of the photosensitive drum 101. The photosensitive drum 101 is thus cleaned and used repeatedly. Such a process is referred to as a cleaning process.

In the image forming apparatus 10 shown in FIG. 1, a part of the toner 110 which is insufficiently charged may be transferred to the transfer belt 17 from the photosensitive drums 101 of the developing devices 31 to 34 in the paper-to-paper interval during continuous printing or other periods of time. As the transfer belt 17 rotates and moves in a direction shown by arrows F and R, the toner transferred onto the transfer belt 17 is removed from the transfer belt 17 by the transfer belt cleaning blade 24 and stored in the toner box 25. The transfer belt 17 is thus cleaned and used repeatedly.

Referring to FIG. 1, in a double-sided printing operation, the paper conveying rollers 45*k* to 45*x* convey the recording paper 50, and the conveying path switching guides 41 and 42 switch the conveying path and guide the conveyed recording paper 50. Detailed description thereof is omitted here.

EXAMPLES

In the following Examples 1 and 2, clear toners for developing electrostatic charge image according to this embodiment were produced under various conditions.

Example 1

In Example 1, clear toners of Experiments 1 to 4 and Comparative Experiments 1 to 5 were obtained.

Experiment 1

An aqueous medium or phase in which an inorganic dispersant is dispersed was obtained as follows. 650 parts by weight (hereinafter simply referred to as "parts") of industrial trisodium phosphate dodecahydrate was mixed with and dissolved in 19,540 parts of deionized water at a liquid temperature of 60° C., and added with dilute nitric acid for pH adjustment. The mixture was added with a calcium chloride solution obtained by dissolving 320 parts of industrial calcium chloride anhydride in 2,560 parts of deionized water, and stirred by Neo Mixer (manufactured by Primix Corporation) at a speed of 4,300 revolutions per minute (rpm) for 34 minutes while being maintained at a temperature of 60° C., so that an aqueous medium containing a suspension stabilizer or dispersant was prepared.

Meanwhile, an oil phase component is obtained by dissolving or dispersing a binder resin and an additive in an organic solvent as follows. 3,120 parts of ethyl acetate was heated to a liquid temperature of 50° C. and stirred, and successively added with 17 parts of an alcohol-modified paraffin wax having a melting point of 67° C. as a release agent, 1.0 parts of a charge control resin as a charge control agent, and 1.4 parts of a fluorescent brightener. Then, the mixture was added with 640 parts of a polyester resin modified with a long-chain alkyl group represented by the above formula (1) to increase its hydrophobicity, and stirred until no solid remained, so that an oil phase was prepared. The polyester resin was synthesized from three kinds of components: an alcohol component, a carboxylic acid component, and a long-chain alkyl group of the formula (1). In Experiment 1, a ratio of the long-chain alkyl group in the polyester resin (hereinafter referred to as "addition ratio") or an addition amount of the long-chain alkyl group was 7.0 mol %. The addition ratio R is represented by the equation $R=N3/(N1+N2+N3)$, where N1 is the number of moles of the alcohol component, N2 is the number of moles of the carboxylic acid component, and N3 is the number of moles of the long-chain alkyl group. The polyester resin had an acid value of 4.9 mgKOH/g and a weight-average molecular weight of 16,000.

The oil phase was added to the aqueous medium maintained at a temperature of 60° C. and suspended by stirring at a speed of 1,000 rpm for 5 minutes to form particles. After that, the ethyl acetate was removed therefrom by distillation under reduced pressure.

The slurry containing the particles was added with Nitric acid to adjust the pH of the slurry to 1.5 or lower, and stirred. Then, tricalcium phosphate as a suspension stabilizer was dissolved therein, and dehydration was carried out. The dehydrated particles were re-dispersed in deionized water and stirred so as to be subjected to water washing. After that, through dehydration and drying processes, toner particles were obtained.

Then, an external addition process was performed as follows. 1.0 parts of hydrophobic silica RX50 (manufactured by Nippon Aerosil Co., Ltd., having an average primary particle diameter of 40 nm) and 0.8 parts of hydrophobic silica RX200 (manufactured by Nippon Aerosil Co., Ltd., having an average primary particle diameter of 12 nm) were added to 100 parts of the obtained toner particles, and stirred for 10 minutes at a rotational speed of 5,400 rpm with a 10-liter Henschel mixer, so that the toner was obtained.

Experiment 2

The toner of Experiment 2 was obtained in the same manner as Experiment 1, except that the acid value of the polyester resin was 6.3 mgKOH/g, and the weight-average molecular weight of the polyester resin was 20,000.

Experiment 3

The toner of Experiment 3 was obtained in the same manner as Experiment 1, except that the addition ratio was 6.5 mol %, the acid value of the polyester resin was 7.0 mgKOH/g, and the weight-average molecular weight of the polyester resin was 28,000.

Experiment 4

The toner of Experiment 4 was obtained in the same manner as Experiment 1, except that the addition ratio was 7.5 mol %, the acid value of the polyester resin was 5.5 mgKOH/g, and the weight-average molecular weight of the polyester resin was 21,000.

Comparative Experiment 1

The toner of Comparative Experiment 1 was obtained in the same manner as Experiment 1, except that the addition ratio was 8.0 mol %, the acid value of the polyester resin was 2.8 mgKOH/g, and the weight-average molecular weight of the polyester resin was 33,000.

Comparative Experiment 2

The toner of Comparative Experiment 2 was obtained in the same manner as Experiment 1, except that the addition ratio was 15.0 mol %, the acid value of the polyester resin was 8.7 mgKOH/g, and the weight-average molecular weight of the polyester resin was 18,000.

Comparative Experiment 3

The toner of Comparative Experiment 3 was obtained in the same manner as Experiment 1, except that the acid value of the polyester resin was 3.4 mgKOH/g, and the weight-average molecular weight of the polyester resin was 12,000.

Comparative Experiment 4

The toner of Comparative Experiment 4 was obtained in the same manner as Experiment 1, except that the addition ratio was 5.0 mol %, the acid value of the polyester resin was 6.2 mgKOH/g, and the weight-average molecular weight of the polyester resin was 19,000.

Comparative Experiment 5

The toner of Comparative Experiment 5 was obtained in the same manner as Experiment 1, except that the addition ratio was 7.5 mol %, the acid value of the polyester resin was 4.8 mgKOH/g, and the weight-average molecular weight of the polyester resin was 14,000.

<Evaluation>

Each of the toners of Experiments 1 to 4 and Comparative Experiments 1 to 5 was evaluated. The evaluation included examination of the tricalcium phosphate and the wax in the toner, printing evaluation of the toner, measurement of the melt viscosity of the toner, and evaluation of the storage stability of the toner. In the printing evaluation, fog, filming, and glossiness were evaluated by using the above described image forming apparatus 10. The fog is a phenomenon in which the toner adheres to a non-image portion (i.e., a portion not to be developed) on the photosensitive drum 101. The filming is a phenomenon in which the toner adheres to the photosensitive drum 101 or the developing blade 107 in the form of a thin film.

<Analyzing Device and Evaluation Method>

Hereinafter, analyzing devices and evaluation methods will be described.

The acid value of the polyester resin was measured using a titrator DL-58 (manufactured by Mettler Toledo International Inc.) and an electrode DG113 as follows. Approximately 0.5 to 0.6 g of a sample was placed in a screw tube, and added with and dissolved in a mixed solvent. The mixture was subjected to potentiometric titration with 0.01 mol/L ethanol solution of potassium hydroxide to determine the acid value.

The weight-average molecular weight of the polyester resin was determined from the molecular weight distribution of the polyester resin, which was measured by dissolving 0.05 g of the polyester resin in 5 mL of tetrahydrofuran (THF) and performing liquid chromatography using a gel permeation chromatography (GPC) column under the following conditions.

(i) Measurement Apparatus

Shimadzu high speed liquid chromatography Prominence GPC system (manufactured by Shimadzu Corporation)

System controller: CBMF20A

Solvent delivery unit: LC-20AD

On-line degassing unit: DGU-20A3

Column oven: CTO-20A

Differential refractive index detector: RID-10A

LC workstation: LCsolution Ver. 1.22SP1

(ii) Analysis Conditions

Column: Shodex GPC KF-803L

Eluent: THF

Flow rate: 1.00 mL/min

Column temperature: 40° C.

(iii) A calibration curve was prepared using 12 kinds of polystyrene standard samples (Shodex STANDARD SM-105 and SL-105 manufactured by Showa Denko K.K.) having molecular weights of $3.73\times10^6$, $1.47\times10^6$, $6.78\times10^5$, $2.57\times10^5$, $1.12\times10^5$, $4.65\times10^4$, $1.98\times10^4$, $6.93\times10^3$, $2.90\times10^3$, $1.93\times10^3$, $1.20\times10^3$, and $0.58\times10^3$.

The tricalcium phosphate and the wax in the toner were examined by observing a cross section of the toner with a transmission electron microscope H-7100 (manufactured by Hitachi, Ltd.) at an acceleration voltage of 100 kV, and whether the tricalcium phosphate was included in the toner and where the wax was located in the toner were determined. The sample for the observation was prepared by a $RuO_4$-stained ultrathin sectioning method.

The fog was evaluated as follows. After continuous printing, the image forming apparatus 10 was turned off during printing of a solid white image. Then, a mending tape (manufactured by Sumitomo 3M Ltd.) was attached to the surface of the photosensitive drum 101. After being peeled off from the photosensitive drum 101, the mending tape was attached to a black paper having high surface smoothness. According to the amount of the toner adhering to the mending tape, printing quality regarding fog was visually evaluated as "good" when no fog was observed, "fair" when slight fog was observed, and "poor" when fog was observed.

The filming was visually evaluated based on the presence or absence of adhering matter on the surfaces of the photosensitive drum 101 and the developing blade 107 after continuous printing. Specifically, printing quality regarding filming was evaluated as "poor" when adhering matter was observed until the number of printed sheets reached 2,000, and "good" when no adhering matter was observed until the number of printed sheets reached 2,000.

The glossiness was evaluated as follows. The exposure, development, and transfer processes were performed so that a clear toner image with an adhesion amount of 0.7 mg/cm$^2$ was superimposed on a color toner image on a recording paper, and the fixing process was performed on the recording paper at a fixing temperature of 170° C. The recording paper was a coated paper (OK Top Coat Plus, manufactured by Oji Paper Co. Ltd., having a basis weight of 127.9 g/m$^2$), and the printing speed was 16 papers per minute (ppm). Then, glossiness of the printed surface of the printed recording paper was measured by using a gloss meter GM-26D (manufactured by Murakami Color Research Laboratory) at an incident angle of 75°. According to the measured glossiness value, printing quality regarding glossiness was evaluated as "excellent" when the glossiness was 85 or more, "good" when the glossiness was 80 or more and less than 85, and "fair" when the glossiness was 50 or more and less than 80. No glossiness measurements were carried out for Comparative Experiments 3 to 5 in which filming occurred.

The melt viscosity of the toner was measured at 150° C. using a rheometer VAR-100AD (manufactured by Rheologica) under the following conditions.

(i) Analysis Conditions

Temperature: 50° C. to 230° C.

Geometry: parallel plate with a diameter of 20 mm

Frequency: 1 Hz

Gap: 1 mm (ii) Measurement Procedure

A target temperature of an oven was set to 140° C. When the temperature of the oven reached the target temperature of 140° C., the toner was placed in the oven and left standing at a gap of 1.5 mm for 5 minutes. Then, after the gap was changed to 1 mm and the temperature of the oven was lowered to 50° C., the measurement of the melt viscosity was started.

The storage stability of the toner was evaluated as follows. A metal cylinder with a diameter of 30 mm and a height of 80 mm was placed on a glass plate. 10 g of the toner was put into the cylinder, and a weight of 20 g was placed on the toner. The toner was left standing in an environment at a temperature of 50° C. and a relative humidity of 55% for 48 hours, and the weight and the cylinder were cautiously removed from the toner. Then, weights of 10 g were placed one by one on the toner until the toner collapsed, and the total weight when the toner collapsed was determined. If the toner collapsed at the time of removing the cylinder, the total weight was determined to be 0 g. According to the determined total weight, the storage stability of the toner was judged as "good" when the total weight was 60 g or less, and "poor" when the total weight was more than 60 g.

<Evaluation Results>

Figure 7:
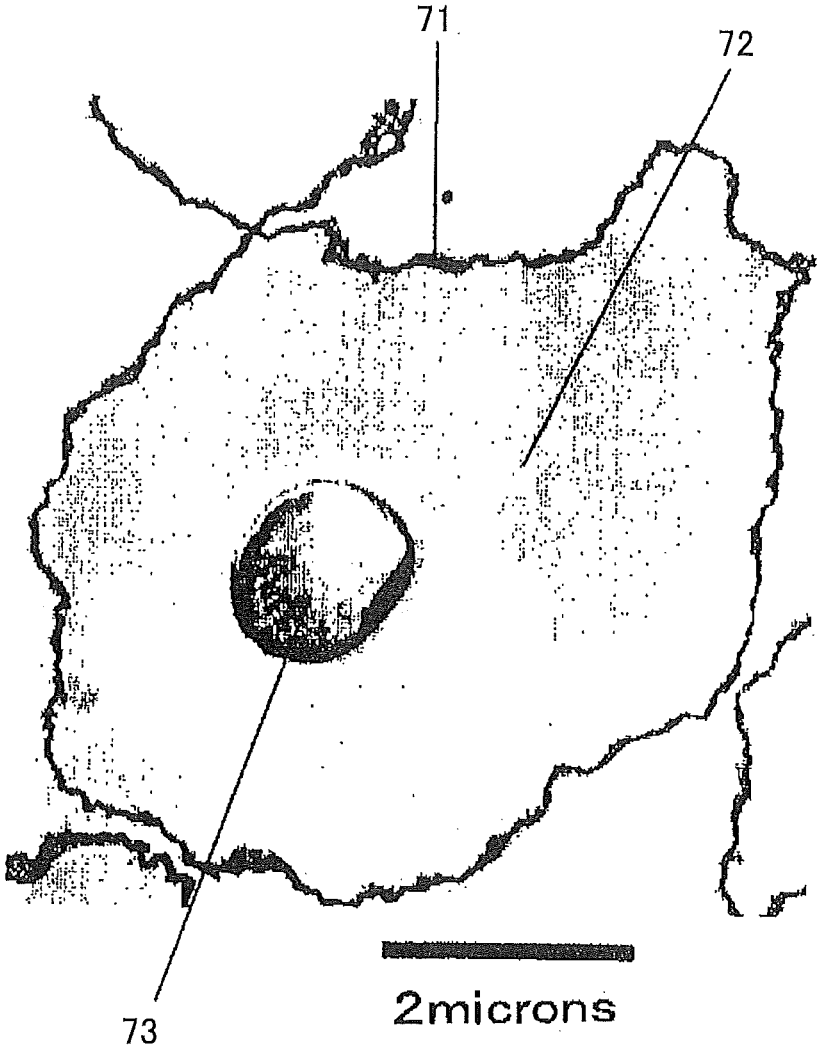
FIG. 7 shows a transmission electron microscope image of a cross section of a toner of Experiment 2.
Figure 8:
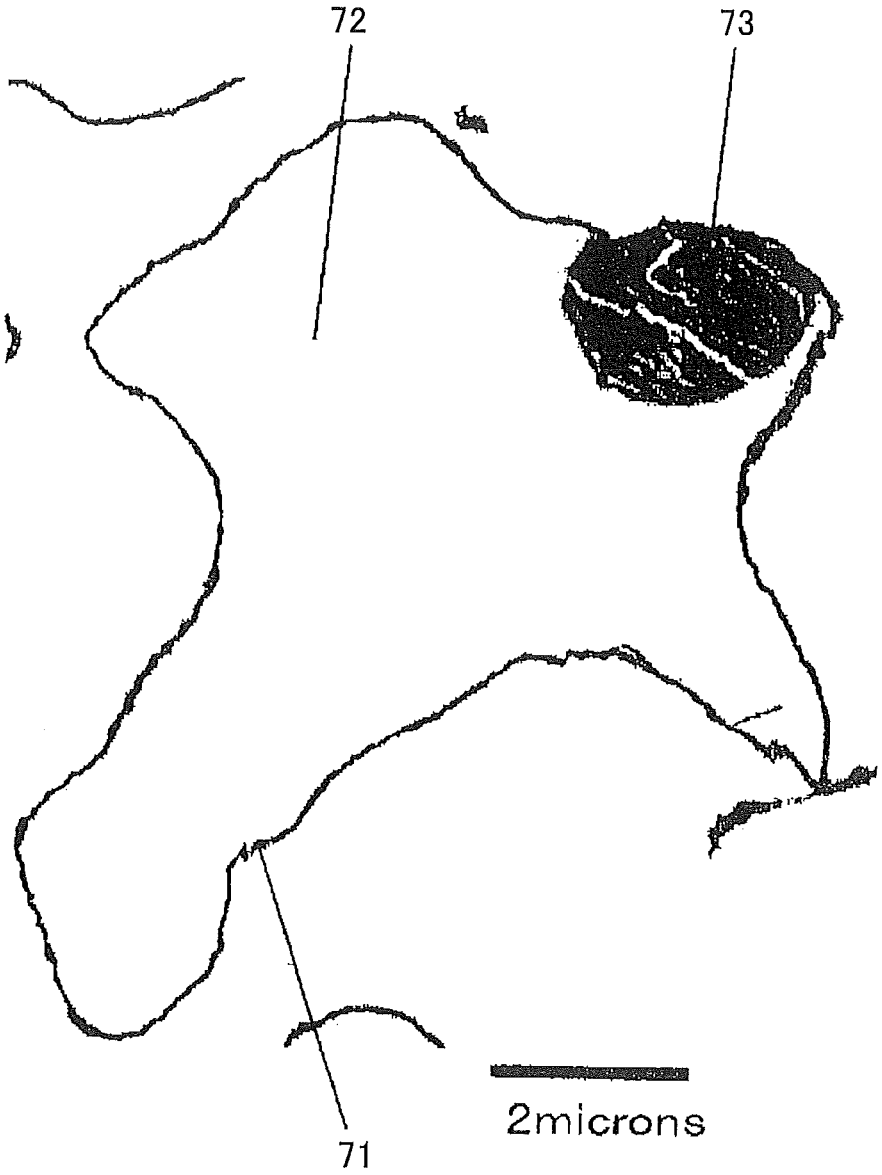
FIG. 8 shows a transmission electron microscope image of a cross section of a toner of Comparative Experiment 3.

FIG. 6 is a table showing the results of the evaluation in Example 1. FIG. 7 shows a transmission electron microscope image of the cross section of the toner of Experiment 2, and FIG. 8 shows that of Comparative Experiment 3. The results of the evaluation will now be described below. Each of FIGS. 7 and 8 shows a toner particle 71 including a binder resin 72 and a wax 73.

For the purpose of stabilization of inclusion of the wax, in Comparative Experiments 1 and 2, the addition ratio or the addition amount of the long-chain alkyl group was increased to 8 mol % and 15 mol %, respectively, to increase the hydrophobicity of the polyester resin, compared to Experiments 1 to 4. As a result, in both Comparative Experiments 1 and 2, although inclusion of the wax improved, the glass transition point of the binder resin lowered due to increase of the long-chain alkyl group, which is a hydrophobic monomer, and thereby the glass transition point of the toner also lowered. This led to poor storage stability. Accordingly, modification with the long-chain alkyl group at an addition amount of 8.0 mol % or more results in a toner having poor storage stability.

In order to investigate incorporation of the suspension stabilizer into the toner, compared to Experiments 1 to 4, the acid value of the polyester resin was decreased to 2.8 mgKOH/g in Comparative Experiment 1, and increased to 8.7 mgKOH/g in Comparative Experiment 2. The toner of Comparative Experiment 1 in which the acid value was decreased included no suspension stabilizer. In contrast, the toner of Comparative Experiment 2 in which the acid value was increased included the suspension stabilizer and caused fog in the printing test. It is thought that, compared to a resin with a low acid value, a resin with a high acid value has more hydrophilic groups, such as carboxyl groups, on its surface, and therefore has higher affinity for tricalcium phosphate salt, which is a suspension stabilizer dispersed in an aqueous phase. For this reason, the toner of Comparative Experiment 2 is thought to have included the suspension stabilizer. The suspension stabilizer included in the toner is thought to have increased the hygroscopicity of the toner, decreasing the charge amount of the toner, thereby causing fog. Accordingly, a polyester resin with an acid value of 8.7 mgKOH/g or more results in a toner causing fog.

In Comparative Experiments 3 to 5, while there was no incorporation of the suspension stabilizer into the toner, the wax was located on the surface of the toner particle as shown in FIG. 8. The wax exposed on the toner surface melted, resulting in filming and poor storage stability. The reason for this is thought to be as follows.

In Comparative Experiment 4, the acid value was 6.2 mgKOH/g and the addition amount of the long-chain alkyl group was 5.0 mol %, that is, while the acid value was substantially equal to that of Experiment 2, the addition amount of the long-chain alkyl group, which is a hydrophobic monomer, was less than that of Experiment 2. This reduced compatibility between the polyester resin and the wax, allowing the wax to be exposed on the toner surface, thereby resulting in filming and poor storage stability.

In Comparative Experiment 3, the addition amount of the long-chain alkyl group was 7.0 mol % and the acid value of the resin was 3.4 mgKOH/g, that is, while the addition amount of the long-chain alkyl group was equal to that of Experiments 1 and 2, the acid value of the resin was lower than that of Experiments 1 and 2. In Comparative Experiment 5, the addition amount of the long-chain alkyl group was 7.5 mol % and the acid value of the resin was 4.8 mgKOH/g, that is, while the addition amount of the long-chain alkyl group was equal to that of Experiment 4, the acid value of the resin was lower than that of Experiment 4. The wax used in Example 1 had an acid value of 3 to 4 mgKOH/g. Thus, in Comparative Experiments 3 and 5, the binder resin and the wax had substantially the same acid value, and therefore had substantially the same affinity for an aqueous phase. This allowed the wax to be readily exposed on the surface, resulting in filming and poor storage stability.

These results suggest that when the addition amount of the long-chain alkyl group is not more than 5.0 mol % or the acid value is not more than 4.8 mgKOH/g, the wax is exposed on the toner surface, leading to filming and poor storage stability.

On the other hand, in Experiments 1 to 4, there was no incorporation of the suspension stabilizer into the toner and the wax was located in the center of the toner particle as shown in FIG. 7, so neither fog nor filming occurred and the storage stability was good. The glossiness was good.

From the above, it is found that a clear toner with no wax exposed on the toner surface can be obtained by using a polyester resin modified with the long-chain alkyl group at an addition amount of from 6.5 to 7.5 mol % to increase its hydrophobicity and having an acid value of from 4.9 to 7.0 mgKOH/g. According to the toner obtained by this manufacturing method, it is possible to prevent poor printing quality due to the wax or toner filming, or poor storage stability due to the wax. Specifically, by using the above polyester resin, it is possible to obtain, through a dissolution suspension method, a clear toner free of colorant that hardly causes filming and fog, and has good storage stability.

Example 2

In Example 2, clear toners of Experiments 5 and 6 were obtained as described below.

Experiment 5

The toner of Experiment 5 was obtained in the same manner as Experiment 1, except that the addition ratio was 7.5 mol %, the acid value of the polyester resin was 6.5 mgKOH/g, and the weight-average molecular weight of the polyester resin was 18,000.

Experiment 6

A toner of Experiment 6 was obtained in the same manner as Experiment 1, except that the addition ratio was 7.5 mol %, the acid value of the polyester resin was 6.8 mgKOH/g, and the weight-average molecular weight of the polyester resin was 14,000.

<Evaluation>

Each of the toners of Experiments 5 and 6 was evaluated in the same manner as Example 1.

Figure 10:
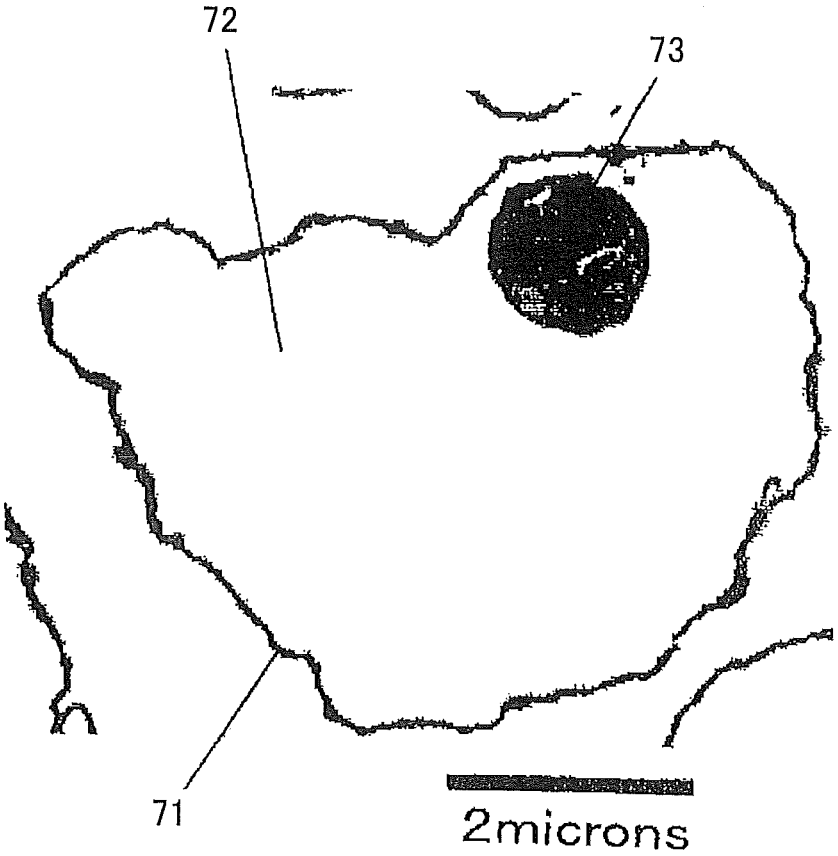
FIG. 10 shows a transmission electron microscope image of a cross section of a toner of Experiment 5.

FIG. 9 is a table showing the results of the evaluation in Example 2. FIG. 10 shows a transmission electron microscope image of the cross section of the toner of Experiment 5. FIG. 10 shows a toner particle 71 including a binder resin 72 and a wax 73.

In Experiment 1, the melt viscosity of the toner at 150° C. was $1.3\times10^2$ Pa·s, and the glossiness at a fixing temperature of 170° C. was 80. On the other hand, in Experiments 5 and 6, respectively, the melt viscosity of the toner at 150° C. was $1.2\times10^2$ Pa·s and $0.98\times10^2$ Pa·s, and the glossiness at a fixing temperature of 170° C. was 89 and 90.

From the results of Experiments 5 and 6, it is found that a toner with no wax exposed on the toner surface can be obtained by using a polyester resin modified with the long-chain alkyl group at an addition amount of 7.5 mol % to increase its hydrophobicity and having an acid value of from 6.5 to 6.8 mgKOH/g.

Furthermore, it is found that when the weight-average molecular weight of the polyester resin is from 14,000 to 18,000 and the melt viscosity of the toner is not more than $1.2\times10^2$ Pa·s, a clear toner image having glossiness higher than that of Experiments 1 to 4 can be obtained under the same fixing temperature condition as in Experiments 1 to 4. When the condition that the weight-average molecular weight of the polyester resin is from 14,000 to 18,000 and the melt viscosity of the toner is not more than $1.2\times10^2$ Pa·s is satisfied, the lower limit of the melt viscosity of the toner is limited to a certain range. It is noted that although the glossiness was measured at a fixing temperature of 170° C. in Examples 1 and 2, the fixing temperature is not limited to this and may be higher than 170° C. The glossiness can be increased by optimizing the fixing temperature.

The weight-average molecular weight of the polyester resin was confirmed to have a small effect on the inclusion of the wax.

Since the toners of Experiments 5 and 6 satisfy the condition described in Example 1, they provide inclusion of the wax (see FIG. 10), prevention of filming and fog, and good storage stability, as shown in FIG. 9.

As described above, by satisfying, in addition to the condition described in Example 1, the condition described in Example 2 that the weight-average molecular weight of the polyester resin is from 14,000 to 18,000 and the melt viscosity of the toner is not more than $1.2\times10^2$ Pa·s, excellent glossiness of 85 or more can be obtained in addition to the advantages described in Example 1.

MODIFICATIONS

Although clear toners, such as clear toners for electrophotography, are illustrated in the above Examples 1 and 2, the present embodiment can be applied to not only clear toners but also other types of toners, and the same effects and advantages as those described in Examples 1 or 2 can be obtained if the present embodiment is applied to a toner other than clear toners.

While the preferred embodiment of the present invention have been illustrated in detail, it should be apparent that modifications and improvements may be made to the invention without departing from the spirit and scope of the invention as described in the following claims.

What is claimed is:

1. A toner for developing an electrostatic charge image, comprising:

toner particles obtained by dissolving or dispersing a binder resin and an additive that is substantially free of colorants in an organic solvent to prepare an oil phase component, and dispersing and granulating the oil phase component in an aqueous medium containing an inorganic dispersant dispersed therein, wherein the binder resin is a polyester resin obtained from an alcohol component, a carboxylic acid component, and a long-chain alkyl group represented by formula (1), the long chain alkyl group being present in a mole percent ranging from 6.5 to 7.5 mol % based on total number of moles of the alcohol component, the carboxylic acid component, and the long-chain alkyl group, and the polyester resin having an acid value of from 4.9 to 7.0 mgKOH/g:

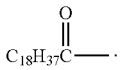

(1)

2. The toner of claim 1, wherein the polyester resin has a weight-average molecular weight of from 14,000 to 18,000, and the toner has a melt viscosity at 150° C. of $1.2\times10^2$ Pa·s or less.

3. The toner of claim 1, wherein the additive includes a release agent.

4. The toner of claim 3, wherein the release agent includes a wax.

5. A toner cartridge comprising a container containing the toner of claim 1.

6. A toner cartridge comprising a container containing the toner of claim 2.

* * * * *